US006202704B1

(12) United States Patent
Thomas et al.

(10) Patent No.: US 6,202,704 B1
(45) Date of Patent: Mar. 20, 2001

(54) METHOD FOR PATTERN REPRESENTATION ON INHOMOGENEOUS CROSSING GRID

(75) Inventors: Wolfgang Thomas, Krefeld; Steffen Böhme, Dresden, both of (DE)

(73) Assignee: EAT GmbH "The DesignScope Company" (DE)

( * ) Notice: Subject to any disclaimer, the term of this patent is extended or adjusted under 35 U.S.C. 154(b) by 0 days.

(21) Appl. No.: 09/491,602

(22) Filed: Jan. 26, 2000

(30) Foreign Application Priority Data

Jan. 26, 1999 (DE) ..... 199 02 995

(51) Int. Cl.[7] ..... D03D 49/00
(52) U.S. Cl. ..... 139/319; 139/332; 139/333
(58) Field of Search ..... 139/317, 318, 139/319, 332, 333

(56) References Cited

FOREIGN PATENT DOCUMENTS

19712631A1 5/1998 (DE) .
0461514A2 12/1991 (FR) .
0692562A1 1/1996 (FR) .

*Primary Examiner*—John J. Calvert
*Assistant Examiner*—Robert H. Muromoto, Jr.
(74) *Attorney, Agent, or Firm*—Robert W. Becker & Associates

(57) ABSTRACT

The invention relates to a method for a pattern representation of inhomogeneous crossing grids of warp and weft yarns, in which a) an inhomogeneous real crossing grid is predetermined based on the real warp yarn density and the real weft yarn density, b) a homogenous virtual point grid with considerably increased resolution is overlaid onto the inhomogeneous real crossing grid, c) a pattern is represented in the homogenous virtual point grid, and d) those points of the virtual homogenous point grid are determined which coincide with crossing points of the real inhomogeneous crossing grid of the pattern.

4 Claims, 3 Drawing Sheets

S1, S3, S5: Steigung $\alpha$

S2, S4: Steigung $\beta$

METHOD FOR PATTERN REPRESENTATION ON INHOMOGENEOUS CROSSING GRID

The invention relates to a method for pattern representation on inhomogeneous crossing grids in the field of textile design.

The goods removal of conventional weaving machines is controlled by a gear system wherein a change, for example, to a different yarn density is performed by a corresponding exchange of gears. For some time now weaving machines have been available in which the goods removal is controlled e.g. by step motors (or other controllable motors). This simplifies manipulation considerably because a changeover now does not require retooling to different gears. Only the electrical control of the step motors must be changed. Furthermore, the step motor drive provides new advantages because in contrast to the rigid gear system, it is possible to provide a variable control of the step motors so that the density of the weft yarns during the weaving process can be changed.

A textile designer determines during pattern conception the bonding points, i.e., the crossing locations between the warp and the weft yarns (threads). This is performed with the aid of so-called weave designs, i.e., the drafting representation of a fabric bonding on special quadrille paper (pattern paper) or on a corresponding quadrille grid representation on a computer monitor. Depending on the fabric quality (warp and weft yarn density) the number of rectangles in the height and width changes for the pattern paper. In a conventional weaving machine, as soon as it is adjusted, the warp and weft yarn base density is constant. In a weaving machine with step motor drive, as mentioned above, the weft yarn density may be constantly changing and may change several times in different ways. This results in the problem that the designer can no longer reproduce a pattern on pattern paper, i.e., with a homogenous grid of identical rectangles (because for a density change a corresponding rectangle change must take place). This problem is independent of whether pattern paper or a corresponding monitor representation is used.

In other words, the pattern designer cannot use the design liberties which are made available by yarn density changes in a step motor driven weaving machine because the fabric bonding with the correlated pattern cannot be represented.

Based on this, the present invention is to provide a method with which patterns for fabrics can be represented in which the warp and/or weft yarn density changes. The change of yarn density can reside in a change of the yarn number per length unit, in a change of the yarn thickness or strength of one or multiple yarns, or in a combination of such measures.

The object is solved by a method for pattern representation on inhomogeneous crossing grids of warp and weft yarns, in which:

a) an inhomogeneous real crossing grid (a1 through a4, b1 through b3) is predetermined based on the real warp yarn density and the real weft yarn density;

b) a homogenous virtual point grid with considerably increased resolution is overlaid onto the inhomogeneous real crossing grid;

c) a pattern (S; S1 through S5) is represented in the homogenous virtual point grid; and d) those points of the virtual homogenous point grid are determined which coincide with the crossing points of the real inhomogeneous crossing grid corresponding to the pattern.

In a preferred embodiment of the inventive method, interpolation is performed between neighboring points of the virtual homogenous point grid The interpolation is advantageously based on a small point group which belongs to a single crossing point of the inhomogeneous real crossing grid.

The neighboring point groups are expediently connected by conjoined smaller point groups.

The invention will be explained in the following with the embodiment represented in the drawings, from which further advantages and features can be taken. It is shown in:

FIG. 1 A pixel-oriented grid or quadrille representation corresponding to conventional pattern paper, wherein the warp yarn density (in the direction "a") is identical to the weft yarn density (in the direction "b") (square rectangles on the pattern paper);

FIG. 4A and

Figure 3:
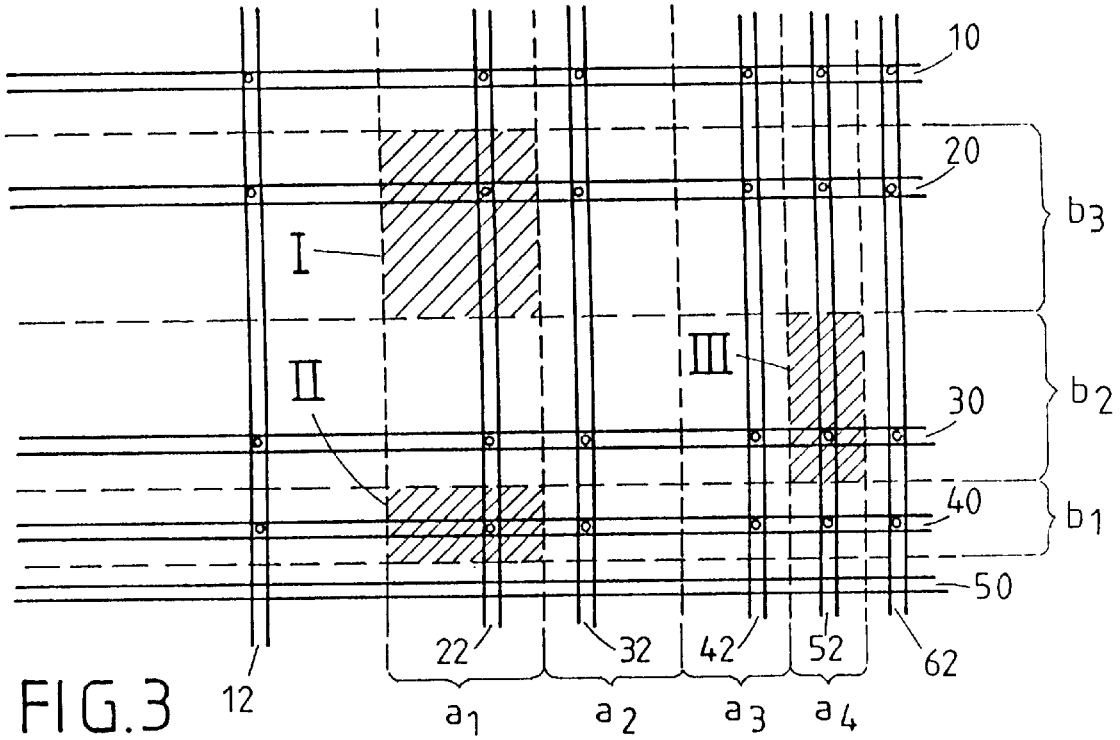
FIG. 3 shows an inhomogeneous real crossing grid between warp yarns 12, 22 . . . 62 and weft yarns 10, 20. . ., 50.
Figure 5:
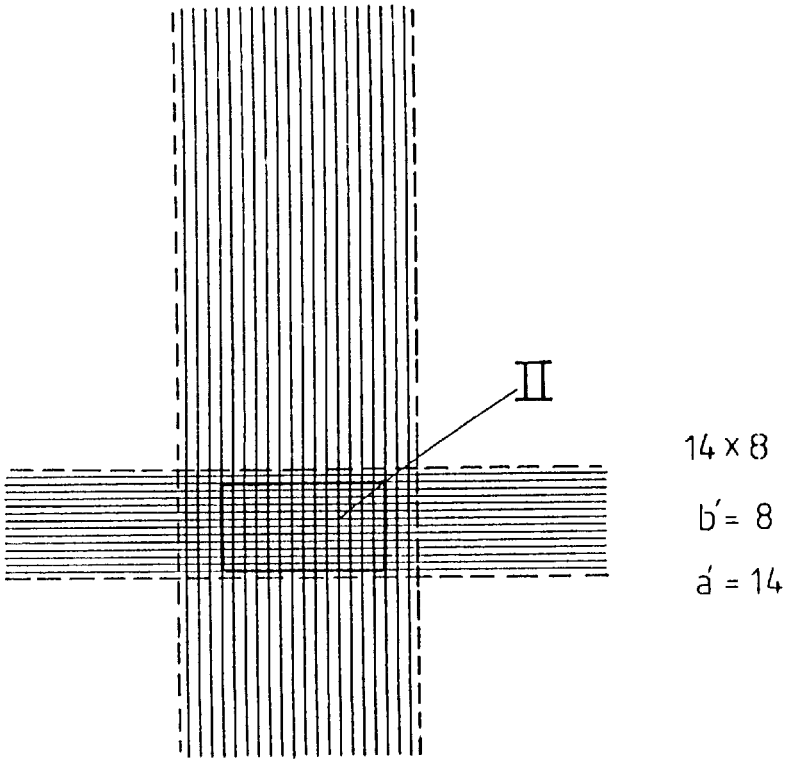
Figure 4A:
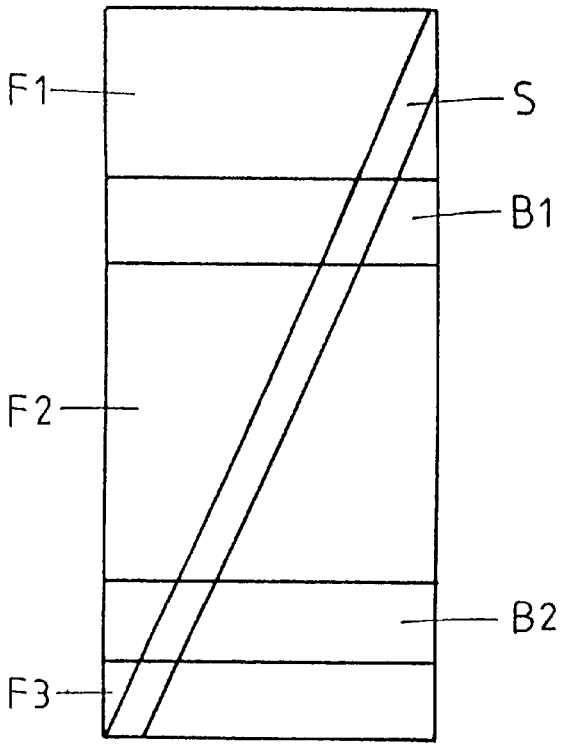
Figure 4B:
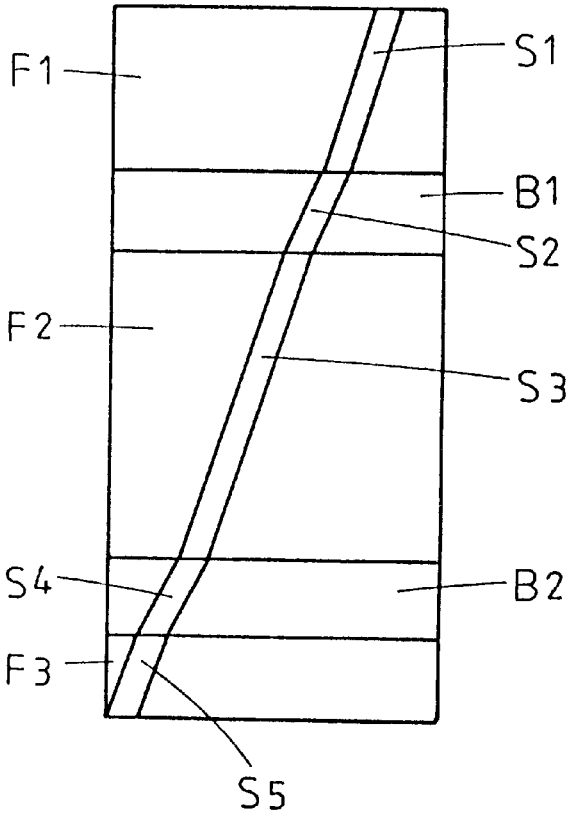

FIG. 4B show a towel with three terry cloth portions F1, F2, F3 and two borders B1, B2 as well as a pattern S, respectively, S1 through S5 extending across the terry cloth portions and the borders;

FIG. 5 shows a detail of a virtual homogenous point grid that is used for overlaying the real inhomogeneous crossing grid represented in FIG. 3 and provides a substantially increased resolution in comparison thereto.

Figure 1:
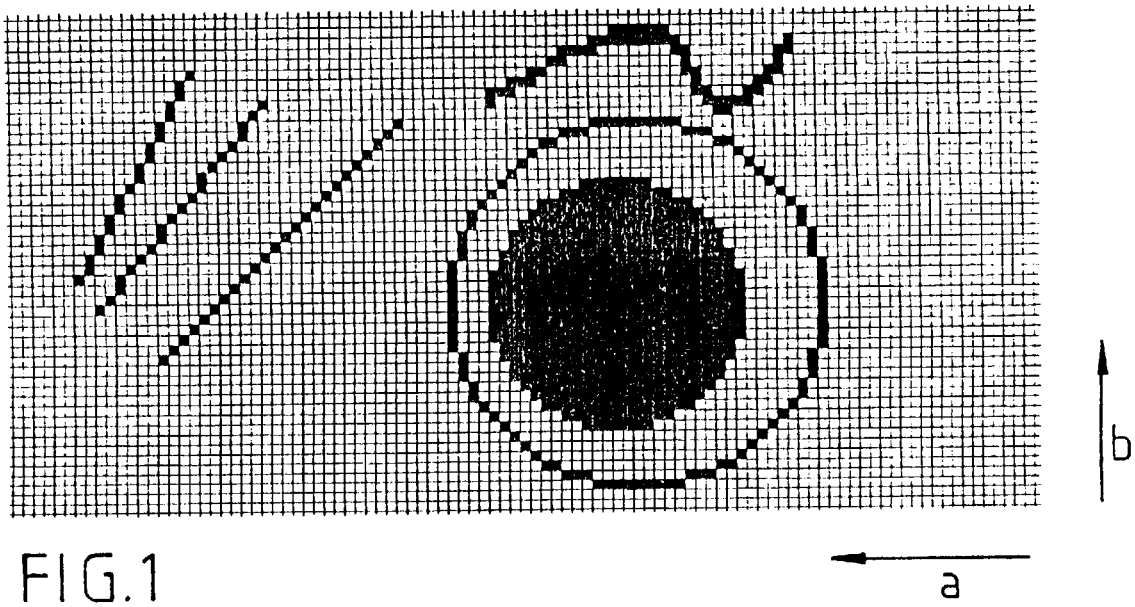
Figure 2:
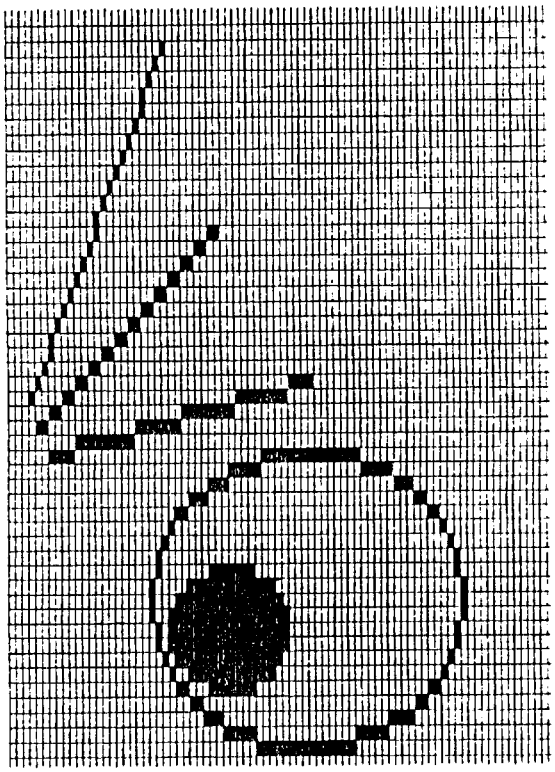
FIG. 2 is a representation corresponding to FIG. 1 wherein the warp yarn density is greater than the weft yarn density (rectangular quadrangles on the pattern paper)

In FIG. 1 multiple patterns are given as examples (three slanted lines, a wave-shaped line, an open and a filled circle) on a conventional quadrille grid of identical squares. This corresponds to conventional drafting programs. FIG. 2 shows a representation which is better adapted to textile designs in which rectangles are used in correlation to different yarn density in the warp and weft yarn direction. In FIG. 1 as well as in FIG. 2 the rectangular grid with crossing locations is homogenous with respect to the pattern, which means that all rectangles are identical. For a change of the yarn density by changeover of a conventional weaving machine, the shape of the rectangles thus will change accordingly.

FIG. 3 shows an inhomogeneous real crossing grid as a greatly enlarged small section. This represents an example in the case in which for a weaving machine with step motor drive the yarn density is changing during operation. The warp yarns 12, 22, 32, 42, 52, and 62 extend in the vertical direction "a" and the weft yarns 10, 20, 30, 40, and 50 extend in the horizontal direction "b". The actual crossing locations are marked by dots. The resulting inhomogeneous crossing grid is determined by the respective yarn spacings and is represented in dashed lines.

While conventionally, as shown in FIGS. 1 and 2, all rectangles are identical, in the inhomogeneous crossing grid according to FIG. 3 this is no longer the case. FIG. 3 shows in cross hatched portions in an exemplary manner three different rectangles which are identified by I, II, III. FIG. 3 thus makes clear that warp yarn densities a1, a2, a3, a4 which are different from one another and weft yarn densities b1, b2, b3 which differ from one another are present.

It is obvious that for a real inhomogeneous crossing grid, as shown in a greatly simplified manner in FIG. 3, no pattern can be conceived. This will be further explained with the fabric represented in FIGS. 4A, 4B which is a towel with three terry cloth portions F1, F2 and F3 which are separated from one another by borders B1, B2 made of a flat fabric. As a simple example for a pattern in FIG. 4A, a slantedly extending strip S is shown which crosses the different fabrics (on the one hand F1 through F3, on the other hand B1, B2). Conventionally, for a towel represented in FIG. 4A the terry cloth portions F1 through F3 are designed separate from the borders B1, B2 and the different control data are then combined in a control program for the weaving machine.

In a weaving machine with step motor drive the conception of the towel would now be possible in one working step wherein at the transition from one terry cloth portion, for example, F1, to the adjacent border B1 the yarn density would be changed. The problem facing the designer is represented in FIG. 4B. Because of the change of the yarn density (corresponding to a change of the rectangles in the conventional representation), the pattern (S in FIG. 4A) no longer corresponds to the desired shape, as can be seen in the jump between the pattern portion S1 and S2. This could be compensated for a simple pattern as a strip S, respectively, S1 through S5 in FIG. 4A, B. However, for complicated patterns, as they are conventional in textile design, this would be impossible. Also impossible would be the design when the yarn density in one certain area would change several times suddenly or even continuously, i.e., from yarn to yarn. Therefore, according to the invention, as is disclosed in patent claim 1, first an inhomogeneous real crossing grid is determined and overlaid by a homogenous virtual dot grid with considerably increased resolution. The corresponding homogenous virtual grid is schematically represented in FIG. 5 and is considerably finer, i.e., has a better resolution than the corresponding real inhomogeneous grid of FIG. 3.

Subsequently, as is represented in FIG. 5 with the crossing location II of FIG. 3, the points of the virtual homogenous dot grid are determined which coincide with a crossing point of the inhomogeneous real crossing grid of the pattern.

The pattern conception thus is performed, after the real fabric has been predetermined by the inhomogeneous real crossing grid, in the plane of the virtual homogenous grid. The plane of the real inhomogeneous crossing grid is connected with the plane of the virtual homogenous crossing grid by a correlated mathematical transformation so that changes in one plane will result in changes in the other plane.

The pattern conception in the virtual homogenous plane allows thus the pattern representation in a known, coherent form, and the transformation into reality, i.e., onto the actual fabric, is performed in the real inhomogeneous plane.

What is claimed is:

1. Method for pattern representation on inhomogeneous crossing grids of warp and weft yards, in which a) an inhomogeneous real crossing grid is predetermined based on the real warp yarn density and the real weft yarn density;

b) a homogenous virtual point grid with considerably increased resolution is overlaid onto the inhomogeneous real crossing grid;

c) a pattern is represented in the homogenous virtual point grid; and d) those points of the virtual homogenous point grid are determined which coincide with crossing points of the real inhomogeneous crossing grid of the pattern.

2. Method according to claim 1, wherein between neighboring points of the virtual homogenous point grid interpolation is performed.

3. Method according to claim 2, wherein the interpolation is based on a small point group which belongs to a single crossing point of the inhomogeneous real crossing grid.

4. Method according to claim 3, wherein the neighboring point groups are connected by conjoined smaller point groups.

* * * * *